US007789244B2

(12) United States Patent
Bazinet

(10) Patent No.: US 7,789,244 B2
(45) Date of Patent: Sep. 7, 2010

(54) APPARATUS AND METHOD FOR RECUPERATING OBJECTS FROM A MIXTURE

(76) Inventor: Dominic Bazinet, 2805 Barclay Ave., #10, Montreal, Quebec (CA) H3S 1J7

( * ) Notice: Subject to any disclaimer, the term of this patent is extended or adjusted under 35 U.S.C. 154(b) by 0 days.

(21) Appl. No.: 12/417,404

(22) Filed: Apr. 2, 2009

(65) Prior Publication Data

US 2009/0255854 A1 Oct. 15, 2009

Related U.S. Application Data

(60) Provisional application No. 61/064,918, filed on Apr. 3, 2008.

(30) Foreign Application Priority Data

Apr. 2, 2008 (CA) ..... 2626412

(51) Int. Cl.
*B07C 1/00* (2006.01)
*B07C 5/344* (2006.01)

(52) U.S. Cl. ..... 209/651; 209/654; 209/916; 209/567; 209/570

(58) Field of Classification Search ..... 209/385, 209/389, 561, 651, 654, 567, 570, 916; 340/568.1; 324/239; 134/134
See application file for complete search history.

(56) References Cited

U.S. PATENT DOCUMENTS

| | | | | |
|---|---|---|---|---|
| 2,078,605 | A * | 4/1937 | Humphreys | 209/457 |
| 2,577,754 | A * | 12/1951 | Hardinge | 209/463 |
| 4,494,657 | A | 1/1985 | Oldenkamp | |
| 5,797,497 | A * | 8/1998 | Edwards | 209/570 |
| 6,667,689 | B1 | 12/2003 | Steffen et al. | |
| 7,683,779 | B1 * | 3/2010 | Pacheco | 340/568.1 |
| 2004/0000904 | A1 * | 1/2004 | Cotter | 324/239 |
| 2007/0204888 | A1 * | 9/2007 | Miller | 134/134 |

* cited by examiner

*Primary Examiner*—Gene Crawford
*Assistant Examiner*—Terrell H Matthews
(74) *Attorney, Agent, or Firm*—Fay Kaplun & Marcin, LLP

(57) ABSTRACT

There is provided an apparatus for recuperating at least one target object from a mixture conveyed to a refuse container, the apparatus comprising a tray having an upstream end for receiving the mixture and a downstream end adapted to be positioned above the refuse container, a moving member for conveying the mixture at a predetermined speed from the upstream end to the downstream end of the tray, a control module and a target object detector mounted near the downstream end of the tray, the object detector providing a first signal to the control module when no target object is detected in the mixture and a second signal when a target object is detected in the mixture. The control module stops the moving member from conveying the mixture upon reception of the second signal so that the detected target object can be recuperated.

15 Claims, 17 Drawing Sheets

APPARATUS AND METHOD FOR RECUPERATING OBJECTS FROM A MIXTURE

CROSS-REFERENCE TO RELATED APPLICATION

The present application claims the benefits of Canadian patent application No. 2,626,412 filed Apr. 2, 2008, and U.S. provisional patent application No. 61/064,918 filed Apr. 3, 2008, which are hereby incorporated by reference.

TECHNICAL FIELD

The present invention relates to an apparatus and method for recuperating objects from a mixture. More specifically, the present invention relates to an apparatus and method for recuperating metal flatware from a mixture of food wastes being discarded to a garbage can.

BACKGROUND

It is generally known that restaurants experience lost of flatware, i.e. eating and serving utensils (as knives, forks, and spoons), as a result of some of them being inadvertently discarded in garbage cans while discarding food wastes after meals. This may represent significant costs, so that many solutions have been provided in the prior art in attempt to detect and/or retain or separate such valuable articles, usually made of ferromagnetic or conductive metal, from the rest of the food wastes.

An example of a solution provided by the prior art involves trash can lids defining a circular inlet or funnel inlet provided with at least one metal detecting ring or coil to detect metal flatware passing nearby and emitting an alarm to prompt the user to recuperate the article(s) among the trash in the can. However, users are often not inclined to make the effort of finding and recuperating flatware articles once dropped in the can. Moreover, valueless metal objects such as aluminum foils used for wrapping food or as an intermediate liner in juice packs or napkin packs are detected and cause false alarms.

Another example involves a trash can cover defining a sloping chute plate provided with a magnet to attract and retain ferromagnetic flatware mixed in the food wastes being directed into the trash can. However, it is known that in actual use many of the flatware articles thrown in the can fall too fast or too far from the magnet to be effectively retained thereby so that many are nevertheless lost in the can. Moreover, certain valuable flatware articles among the most expensive, such as those being made of non-ferromagnetic stainless-steel or silver are not subject to magnetic attraction.

Other apparatuses provided with complex moving parts and actuators found in the prior art attempt to prevent detected flatware from being directed into a trash can by rapidly blocking an entry at the base of a chute to allow recuperation of the articles or deflecting the article(s) toward a receptacle for recuperation. However, in real applications, such mechanism do not prove to be reliable enough to deal with the speed of free falling or rapidly thrown metal objects and mechanical and electromagnetic interferences created by the surrounding mass of wastes.

Accordingly, there is a need for an apparatus and method for effectively detecting and recuperating metal objects mixed among wastes directed to a refuse container.

SUMMARY

According to the present invention, there is provided an apparatus for recuperating at least one target object from a mixture conveyed to a refuse container, the apparatus comprising:

- a tray having an upstream end for receiving the mixture and a downstream end adapted to be positioned above the refuse container;
- a moving member for conveying the mixture at a predetermined speed from the upstream end to the downstream end of the tray;
- a control module; and
- a target object detector mounted near the downstream end of the tray, the object detector providing a first signal to the control module when no target object is detected in the mixture and a second signal when a target object is detected in the mixture;
- whereby the control module stops the moving member from conveying the mixture upon reception of the second signal so that the detected target object can be recuperated.

According to the present invention, there is also provided an apparatus for recuperating at least one target object from a mixture conveyed to a refuse container, further comprising a recuperation container and wherein the control module includes an actuator operatively connected to the tray, whereby the control module stops the moving member from conveying the mixture upon reception of the second signal, activates the actuator so that the downstream end of the tray is positioned above the recuperation container and resumes the moving member conveying the mixture and stops the moving member from conveying the mixture upon reception of the first signal, activates the actuator so that the downstream end of the tray is positioned above the refuse container and resumes the moving member conveying the mixture.

According to the present invention, there is also provided an apparatus for recuperating at least one target object from a mixture conveyed to a refuse container, further comprising a recuperation container and wherein the control module includes an actuator operatively connected to the refuse container and the recuperation container, whereby the control module stops the moving member from conveying the mixture upon reception of the second signal, activates the actuator so that the recuperation container is positioned under the downstream end of the tray and resumes the moving member conveying the mixture and stops the moving member from conveying the mixture upon reception of the first signal, activates the actuator so that the refuse container is positioned under the downstream end of the tray and resumes the moving member conveying the mixture.

According to the present invention, there is further provided a method for recuperating at least one target object from a mixture, the method comprising:

- providing a refuse container;
- providing a target object detector;
- conveying the mixture at a predetermined speed toward the refuse container;
- stopping conveying the mixture to the refuse container upon detection of a target object in the mixture by the target object detector and recuperating the target object from the mixture; and resuming conveying the mixture at the predetermined speed towards the refuse container upon non-detection of the target object by the target object detector.

According to the present invention, there is also provided a method for recuperating at least one target object from a mixture, further comprising providing a recuperation container, wherein the step of recuperating the target object from the mixture comprises conveying the target object containing mixture towards the recuperation container until non-detection of the target object by the object detector.

The foregoing and other objects, advantages and features of the present invention will become more apparent upon reading of the following non-restrictive description of illustrative embodiments thereof, given by way of example only, with reference to the accompanying drawings.

DETAILED DESCRIPTION

Figure 1A:
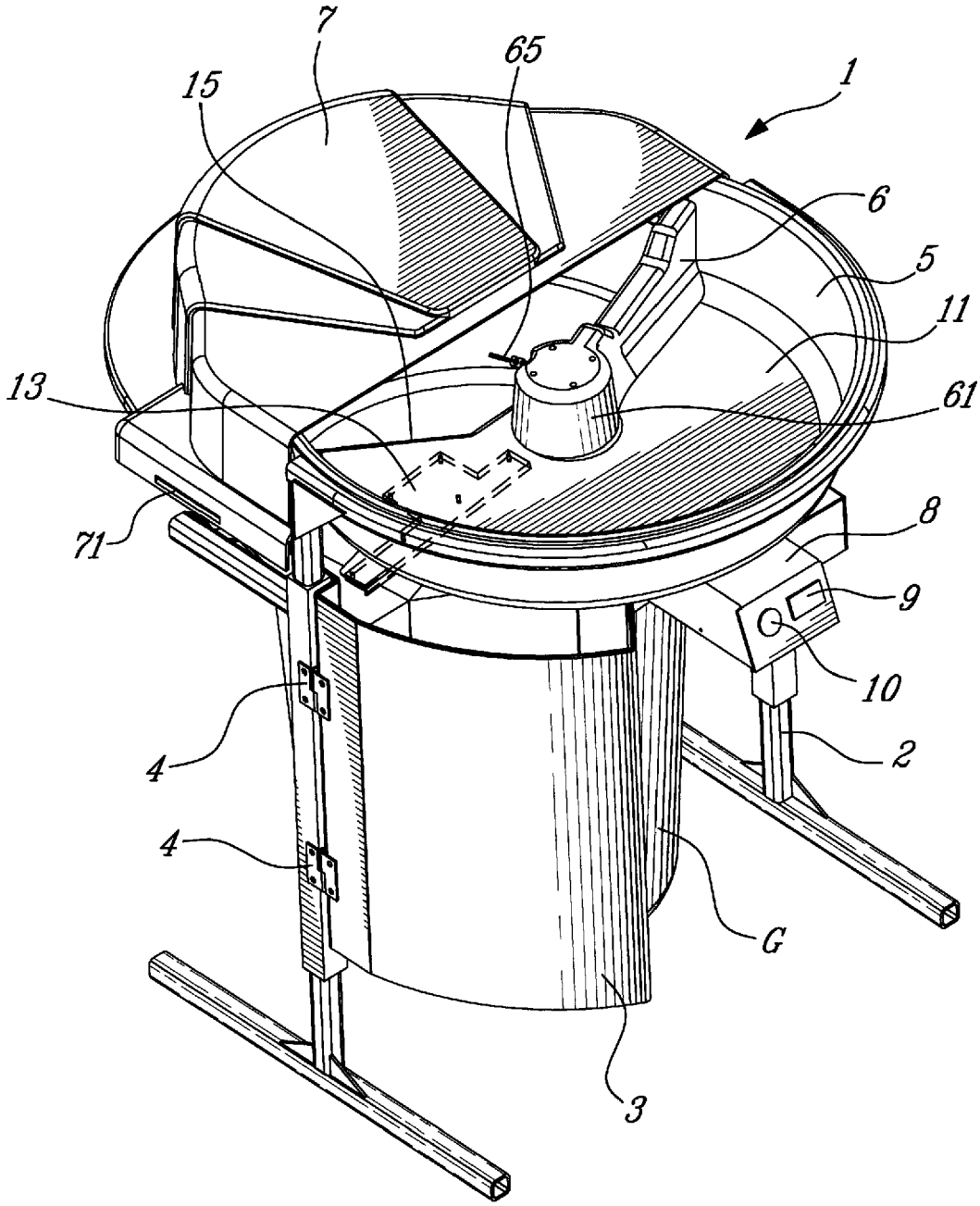
FIGS. 1*a* and 1*b* are top left isometric views of an object recuperation apparatus according to an illustrative embodiment of the present invention, shown in a waste discarding position (FIG. 1*a*) and in an object recuperating position (FIG. 1*b*)

The main problem with the prior art devices and apparatuses, especially those intended for recuperating objects from wastes discharged into a trash container, is that wastes are traveling rapidly toward the container opening, generally free falling or slipping by gravity on a sloping member. Wastes may also be further accelerated by the hasty movement of the operator. Therefore, object detection and sorting becomes an almost insurmountable challenge which leads to poorly performing solutions.

It has been found that conveying the wastes including objects, such as valuable articles, at a steady predetermined speed on a substantially horizontal surface first improves detection reliability and, secondly, enables full control of the wastes and objects flow travel, which in turn enables manual or automatic intervention to recuperate the objects before they enter a trash container to be carried out within a reasonable timeframe. Embodying such a concept into a simple and compact apparatus, however, presented a design challenge which led to the present invention. The use of the apparatus and method may be extended to various other applications where objects have to be detected and recuperated from a mixture.

It will be appreciated that the non-limitative illustrative embodiments of the present invention generally improve the reliability of object recuperation from wastes without intervention from the operator. Thereby, wastes containing valuable objects, such as cutlery, may be dropped into the apparatus positioned on top of a refuse container to cause the objects to be automatically detected and recuperated in a recuperation container before the rest of the wastes are conveyed into the refuse container. Productivity of the employees is thus improved and maximum savings from valuable objects recuperation are generated using the object recuperation apparatus.

Accordingly, generally speaking, the present invention relates to an apparatus and method for recuperating objects (for example metal flatware) from a mixture (for example food wastes) being discarded to a container (for example a garbage can), and more specifically to an apparatus and method permitting target objects to be recuperated in a first container, while most remaining wastes are discarded to a second container.

Referring to FIGS. 1*a* to 3, an object recuperation apparatus 1 according to an illustrative embodiment of the present invention will now be described. The illustrated apparatus 1 comprises a supporting frame 2 for supporting the top portion of the apparatus 1 above a refuse container G (for example a garbage can), and holding a removable recuperation container 3 through a hook and hinge device 4. The apparatus 1 further comprises a reciprocating tray 5, a moving member in the form of a rotating arm, advantageously a rotating squeegee arm 6 mounted for scraping the inner bottom and wall surfaces of tray 5, a cover 7, and a drive/control module 8. The drive/control module 8 comprises an operator presence sensor 9 such as, for example, an optical or ultrasonic detector, and an ON/OFF button 10. The cover 7 comprises elongated openings 71 on opposite side wings thereof, the openings mating with respective horizontal bars 22 to provide a snap fit.

Figure 1B:
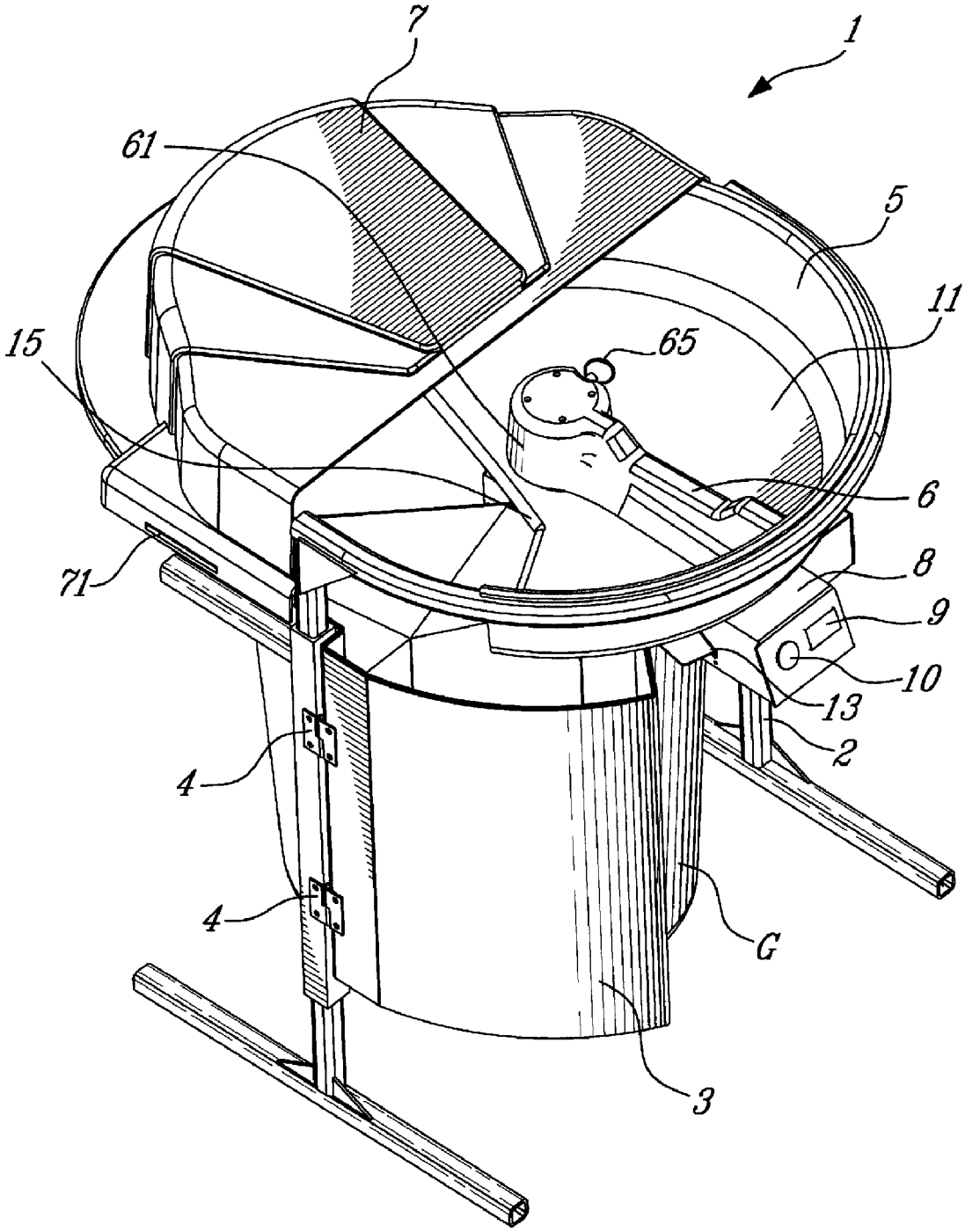
Figure 2A:
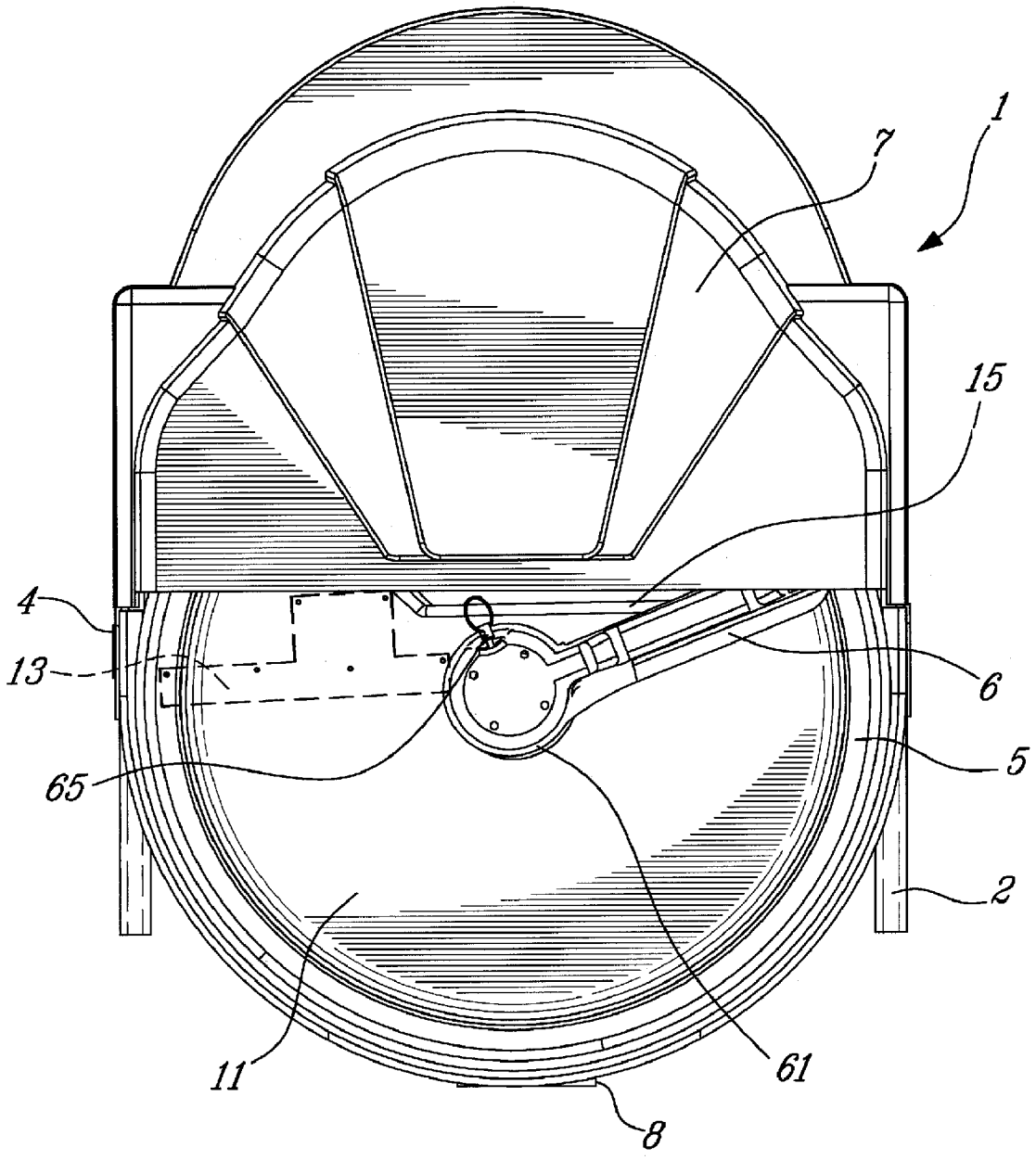
FIGS. 2*a*, 2*b* and 2*c* are, respectively, a top plan view, a left side view and a front elevational view of the object recuperation apparatus.
Figure 2B:
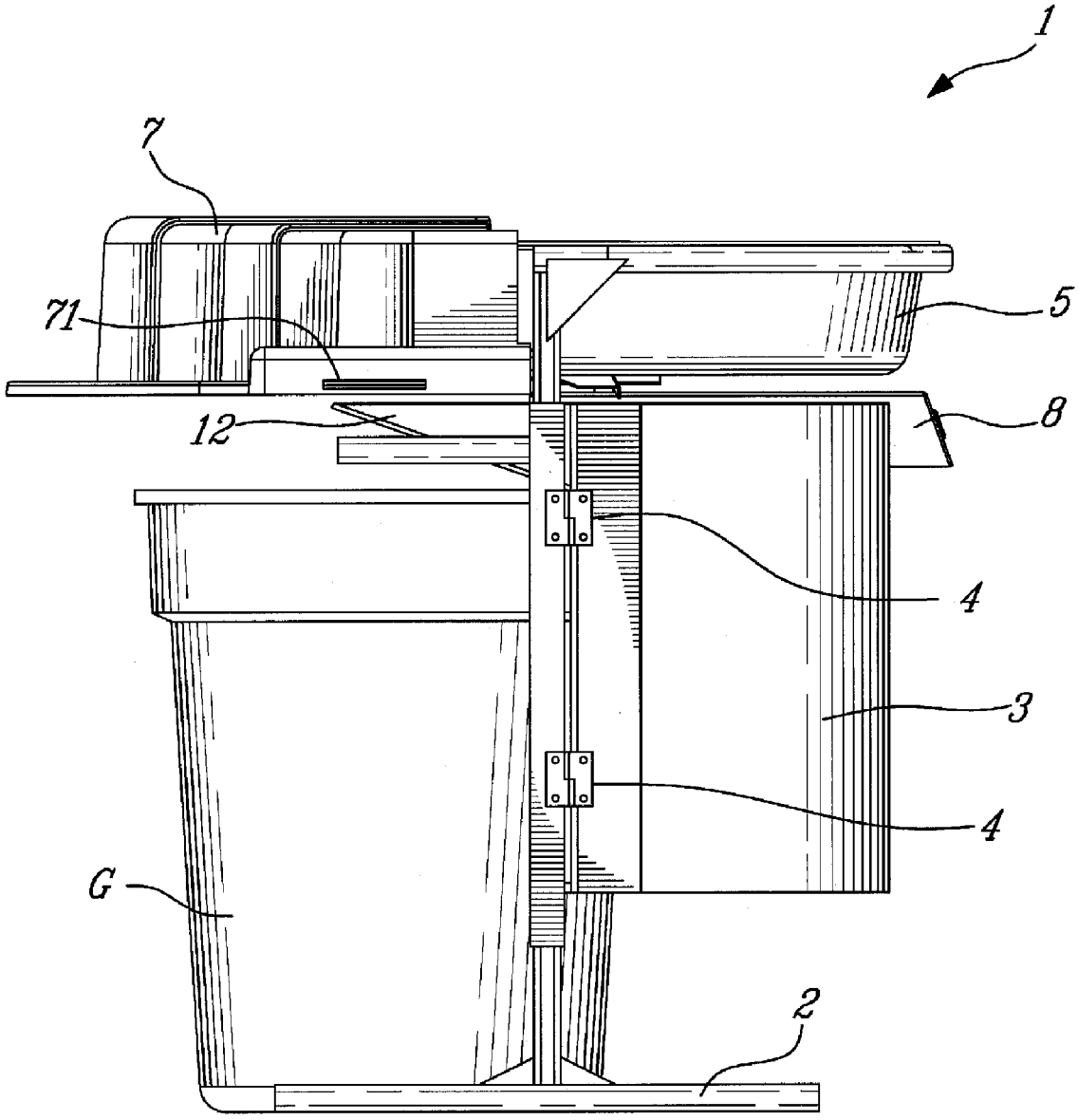
Figure 2C:
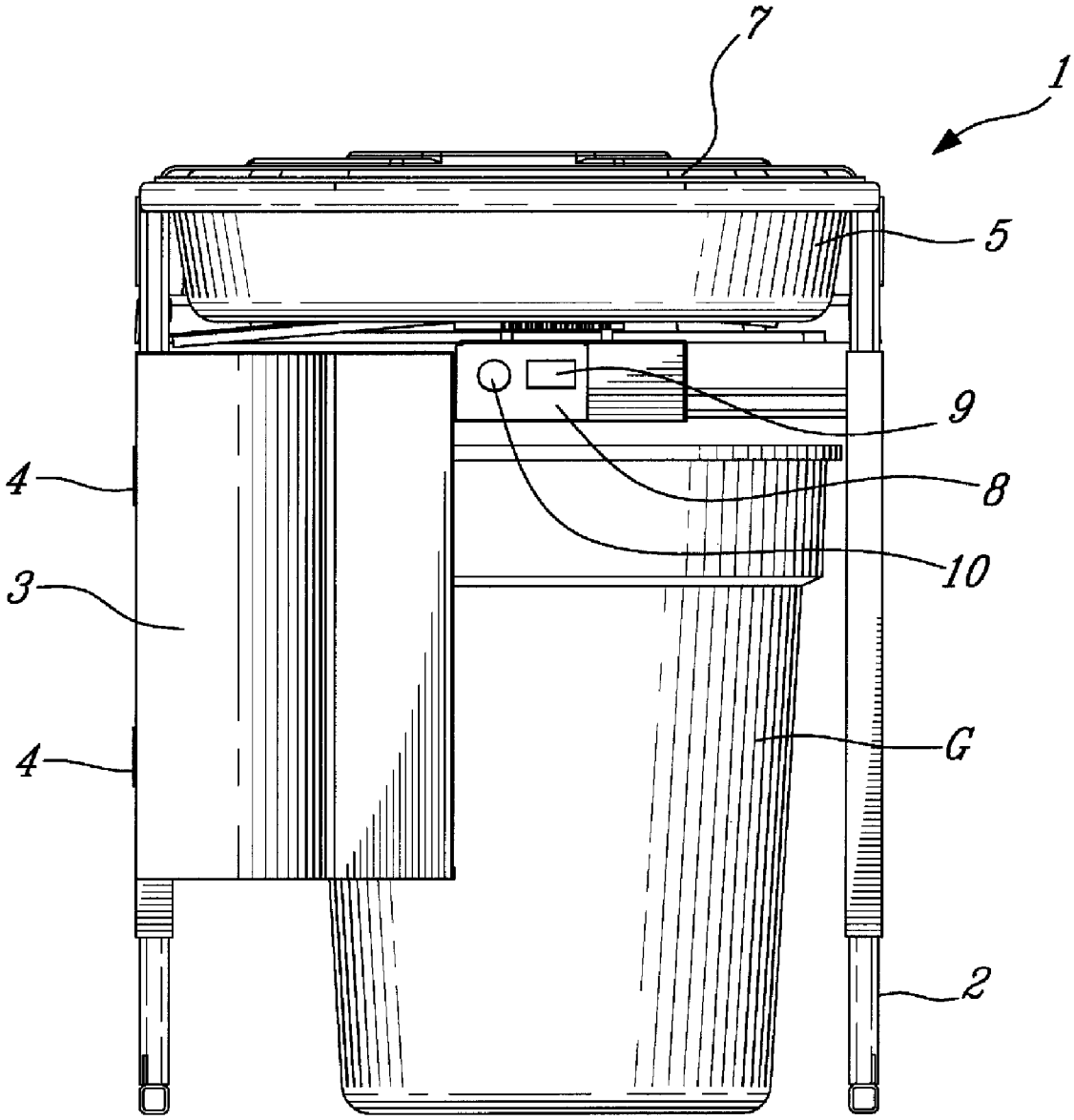
Figure 3:
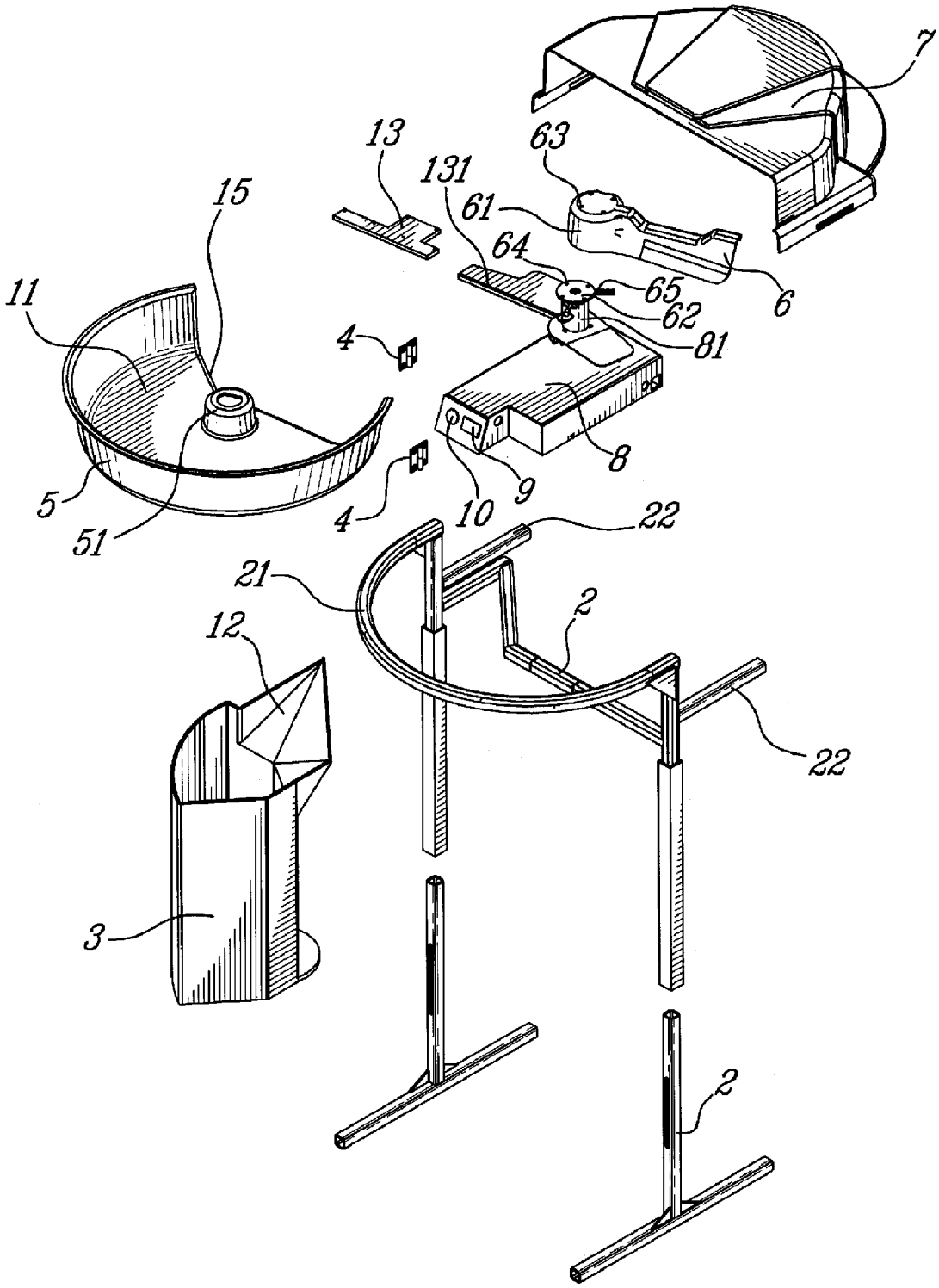
FIG. 3 is an exploded isometric view showing the main components of the object recuperation apparatus.
Figure 4A:
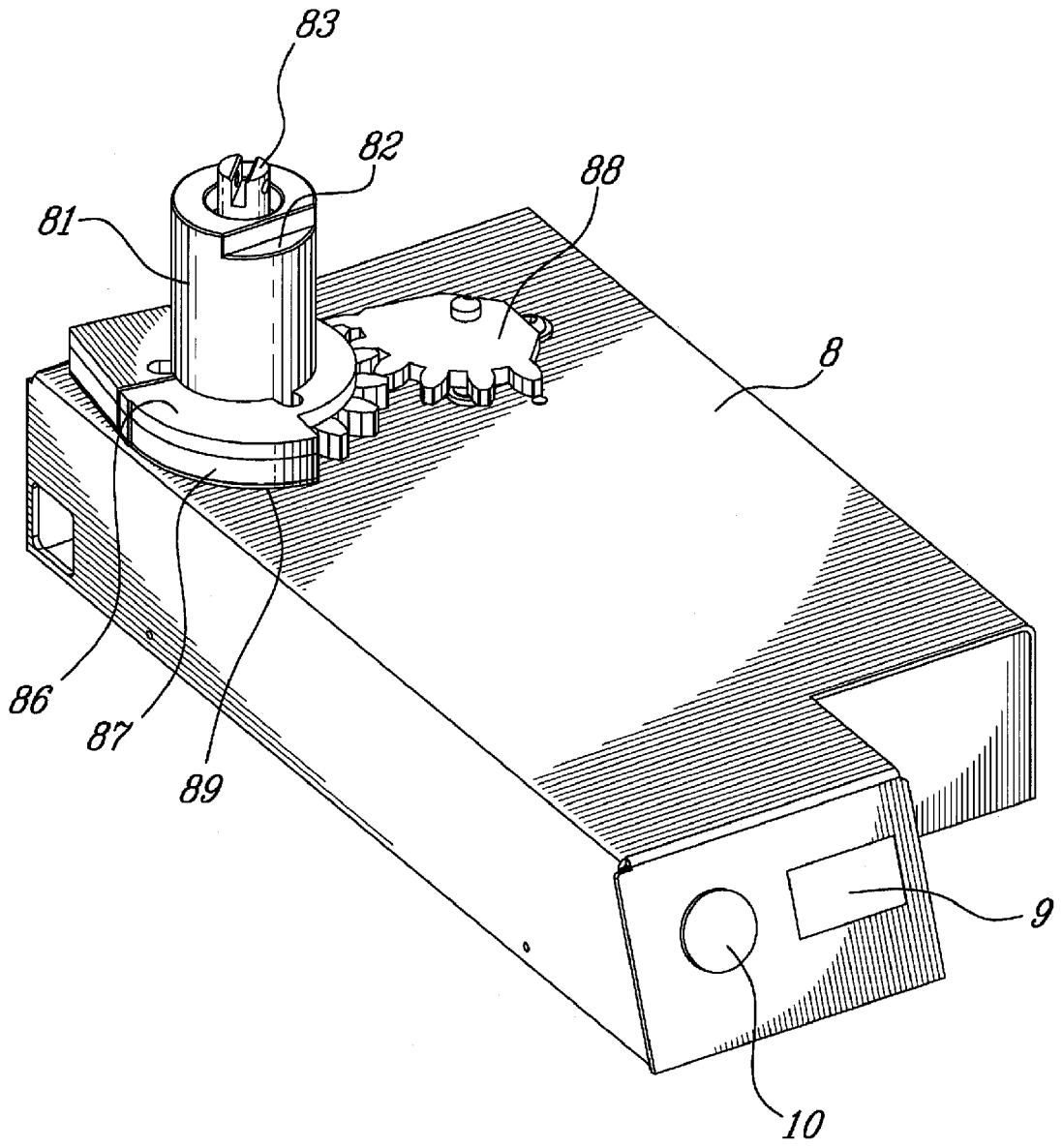
FIGS. 4*a* and 4*b* are enlarged views of a drive/control module of the object recuperation apparatus without (FIG. 4*a*) and with (FIG. 4*b*) the sensor support.
Figure 4B:
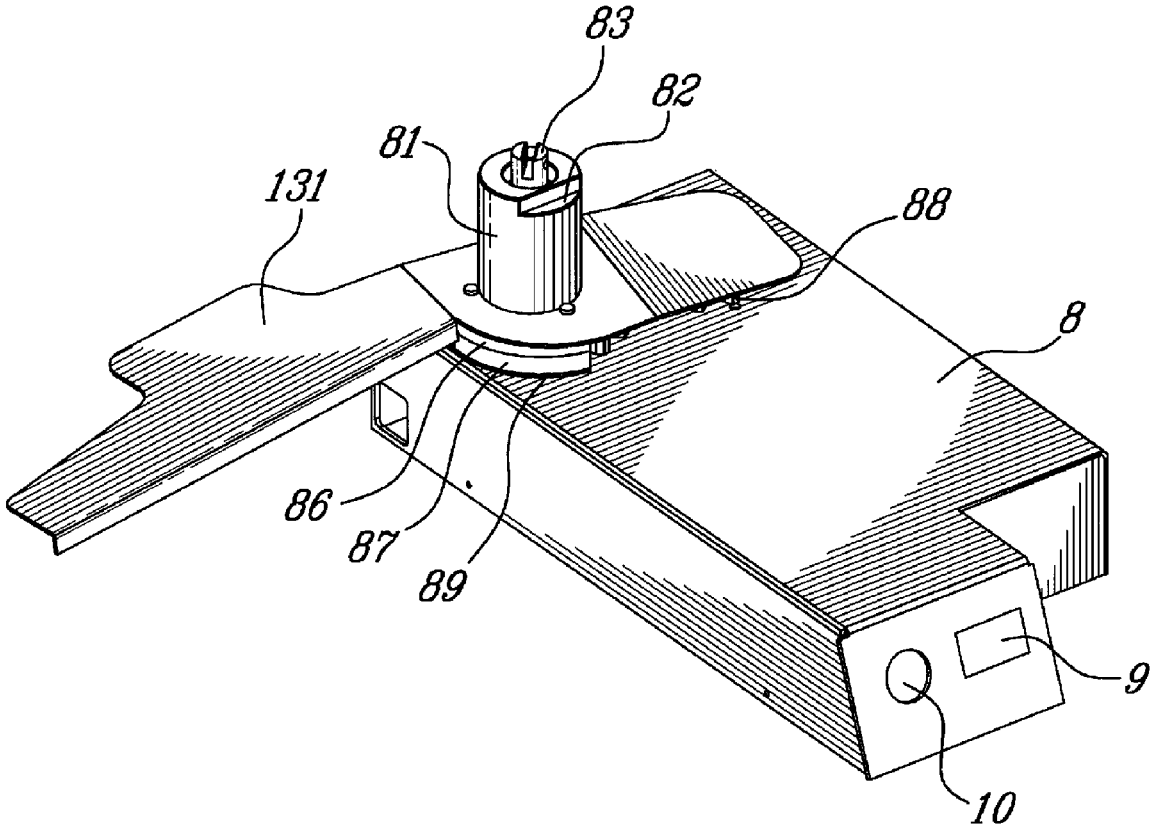
Figure 5:
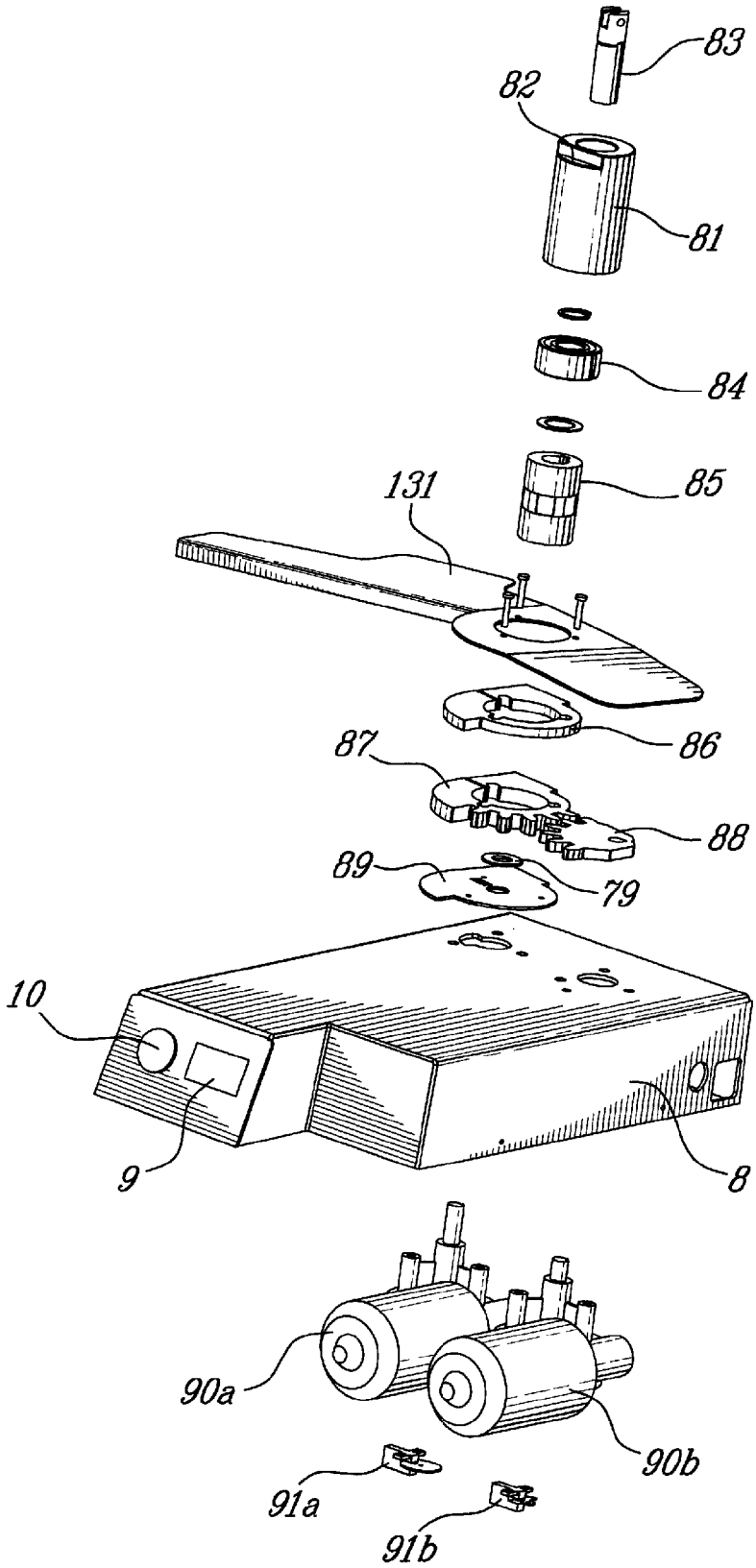
FIG. 5 is an exploded view of the module of FIG. 4*b;*
Figure 6:
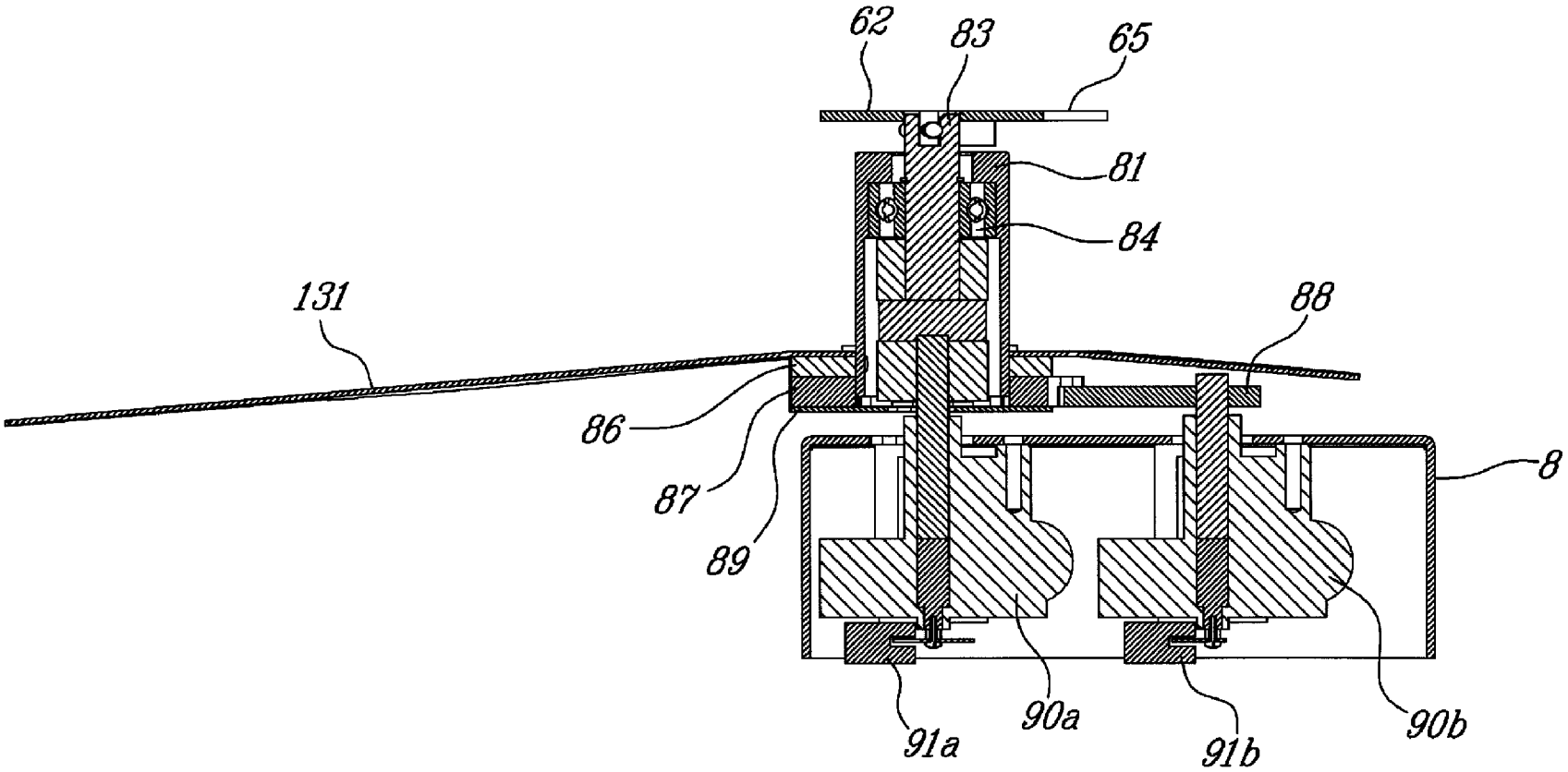
FIG. 6 is an en enlarged cross-sectional view of FIG. 4*b;*

As best seen from FIGS. 1*b* and 3, tray 5 has a truncated circular shape to enable mixture or objects pushed by the squeegee arm 6 rotating in, for example, the clockwise direction to be discharged in a container, the refuse container G or the recuperation container 3, when reaching the end (border) 15 of the downstream portion of tray bottom 11. A chute 12 is also provided below tray 5 between and above refuse container G and recuperation container 3 to prevent objects from falling besides recuperation container 3 when the tray 5 is moving from the discarding position to the recuperation position. An object detector 13, for example a ferromagnetic metal detector, is positioned below that downstream portion (see dotted lines on FIG. 1*a*) to detect objects before they reach the end of the tray 5 and fall in a container. Since in the illustrative embodiment the detector is a ferromagnetic metal detector, the tray 5, the squeegee arm 6 and the chute 12 are made, for example, from plastic material to enable proper operation of the object detector 13. It is to be understood that other types of object detectors can be used depending a specific known property to be detected in order to identify the objects. It is also to be understood that the tray 5, the squeegee arm 6 and the chute 12 may be made of other material not interfering with the operation of the object detector 13.

Referring to the exploded view of FIG. 3, it can be further seen that the squeegee arm 6 comprises a bell shaped end cap 61 in which a mounting plate and shaft assembly 62 is bolted through holes such as 63, to enable driving of the arm 6 by the drive/control module 8, which is connected to a power supply source such as a battery or a power outlet through a power cord (not illustrated). The drive/control module 8 further comprises a rotating hub 81 for driving the tray 5 which is also supported by the spacer 21 of frame 2. The detailed mounting of the tray 5 and arm 6 on the drive/control module 8 will be described in further details bellow. However, it can be mentioned that the object detector 13 is mounted to the rotating hub 81 through a detector support 131 so as to follow the movements of the tray 5, and is electrically connected to the drive/control module 8 to provide a first signal when no object is detected and a second signal when a detectable object is present near the object detector 13.

With reference to FIGS. 4*a*, 4*b*, 5 and 6, details of the drive/control module 8 will now be described. The plate and shaft assembly 62 comprises a cotter pin 65 (best seen in FIG. 6) used to lock the plate and shaft assembly 62 in a vertical bore on top of the drive shaft 83. The drive shaft 83 is directly coupled to a first actuator, such as reversible DC gear-motor 90*a*, through coupler 85. Therefore, rotation of the squeegee arm 6 is directly responsive to activation of motor 90*a*. Proper guidance of drive shaft 83 is ensured by gear spacer 86 and gear 87 connected to clutch closure plate 89 through thrust bearing 79.

The rotating hub 81 is also coupled to the drive shaft 83 through a one-way bearing 84 in such a way that the rotating hub 81 remains steady when motor 90*a* drives squeegee arm 6 in the clockwise direction, but will follow the movement of squeegee arm 6 in the counterclockwise direction when motor 90*a* is being actuated in the reversed direction by drive/control module 8. Gear 87 interacts with gear 88 connected to a second actuator, such as motor 90*b*, in order to return of the rotating hub 81 to its original position when required.

The detector support 131, in order to follow the movements of the tray 5, is connected to the rotating hub 81 through gear spacer 86 and gear 87.

The positions of the squeegee arm 6 and of the tray 5 are indicated to the drive/control module 8 by respective position sensors 91*a* and 91*b* associated with corresponding motors 90*a* and 90*b*. Position sensors 91*a* and 91*b* may be, for example, optical sensors reading reflective patterns on the rotors of motors 90*a* and 90*b* or detecting a rotating pin or ridge.

When motor 90*a* is actuated in the forward mode, squeegee arm 6 is rotated and tray 5 remains steady, but when motor 90*a* is actuated in the reverse mode, tray 5 is driven counterclockwise along with squeegee arm 6. Position sensor 91*b*, or any other appropriate sensor such as a limit switch, serves to indicate to drive/control module 8 that the tray 5 has reached a desired retracted position which corresponds to the position shown in FIG. 1*b*, clearing the opening of recuperation container 3. When motor 90*b* is actuated, tray 5 moves back clockwise until position sensor 91*b*, or any other appropriate sensor such as a limit switch, indicates to drive/control module 8 that it has returned to its initial position corresponding to that of FIG. 1*a*, enabling discarding of mixture into the refuse container G.

Alternatively, motor 90*b* may be replaced by a mechanism using a return spring arrangement co-operating with motor 90*a* in order to provide a cost effective solution for an automatic spring return of the rotating hub 81 to its original position when required.

In Use

In use, the tray 5 is initially in the waste discarding position and the squeegee arm 6 is initially in the back position (as illustrated in FIG. 1*a*). Detection of the presence of an operator by presence sensor 9 and activation of the apparatus 1 by pressing the ON/OFF button 10 starts motor 90*a* and activates the squeegee arm 6 in the clockwise direction. The operator may then drop mixture that may contain valuable objects in tray 5. As long as no object is sensed by object detector 13, a first signal (no object detected) is sent to the drive/control module 8 which continues the activation of motor 90*a* resulting in squeegee arm 6 keeping on scraping the bottom 11 and side wall surfaces of tray 5, pushing mixture in the refuse container G. When object detector 13 detects at least one object near the downstream bottom border 15 of tray 5, a second signal (object detected) is sent to the drive/control module 8 which immediately starts a recuperation sequence of operations.

First, motor 90*a* is stopped, freezing the squeegee arm 6 at its current position to prevent discarding objects into the refuse container G. Then, the motor 90*a* is activated in its reverse mode, which drives tray 5 and squeegee arm 6 in the counterclockwise direction until the retracted position is sensed by position sensor 91*b*, thereby clearing the chute 12 and the opening of the object recuperation container 3. Then, drive/control module 8 activates the motor 90*a* in the forward mode to drive squeegee arm 6 back in the clockwise direction to push objects in the recuperation container 3 until the drive/control module 8 receives the first signal (no object detected) from the object detector 13. At that time, motors 90*b* and 90*a* are activated respectively moving tray 5 and squeegee arm 6 in the clockwise direction until the initial position of the tray is sensed by position sensor 91*b* and the initial position of the squeegee arm 6 is sensed by position sensor 91*a* to resume waste discarding.

If at any time, the apparatus 1 senses that there are no operator present through presence sensor 9, it completes the object recuperation cycle or completes a few rotations of the squeegee arm 6 to clean the tray 5 and then stops squeegee arm 6 in its initial position, waiting for a new operator detection and start signal. When the apparatus 1 is OFF, an operator may pull out and remove the pivotally mounted recuperation container 3, empty its content in a vessel sent to the dishwashing station for recuperation and washing of the objects and replace it in operating position on the hook and hinge support 4. It is to be understood that presence sensor 9 may be omitted, in which case operation of the apparatus 1 is performed simply with the use of the ON/OFF button 10.

Alternatively, the drive/control module 8 may be programmed to stop rotating squeegee arm 6 when an object is detected by the object detector 13 and prompt the operator, leaving to him the option of manually picking the object or starting the automatic recuperation sequence of operations.

It is worth mentioning that the apparatus 1 can be easily dismantled for washing the components in contact with the mixture. The cover 7 can be removed simply by pulling it up. Then, merely pulling out cotter pin 65 frees the squeegee arm 6, which in turn enables the tray 5 to be pulled out of on top of rotating hub 81. Reassembly is just as easy once components have been cleaned up. It is to be noted that good contact of the squeegee arm 6 with the inner surfaces of the tray 5 results in there being no substantial residue build up.

ALTERNATIVE ILLUSTRATIVE EMBODIMENTS

First Alternative Illustrative Embodiment

Figure 7A:
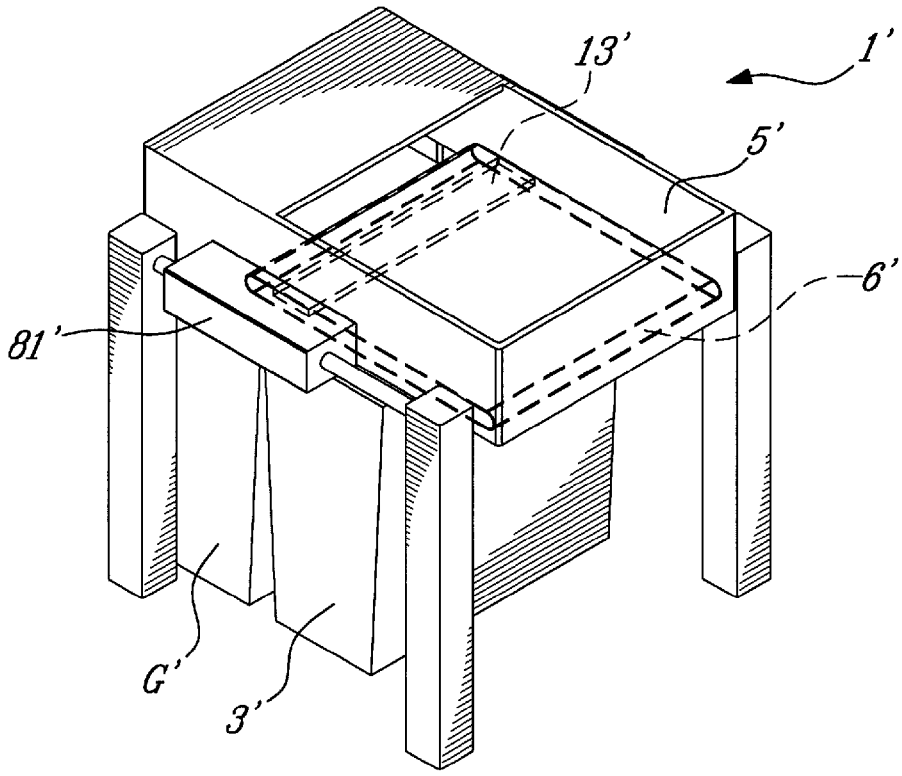
FIGS. 7*a* and 7*b* are top left isometric views of an object recuperation apparatus according to a first alternative illustrative embodiment of the present invention, shown in a waste discarding position (FIG. 7*a*) and in an object recuperating position (FIG. 7*b*)
Figure 7B:
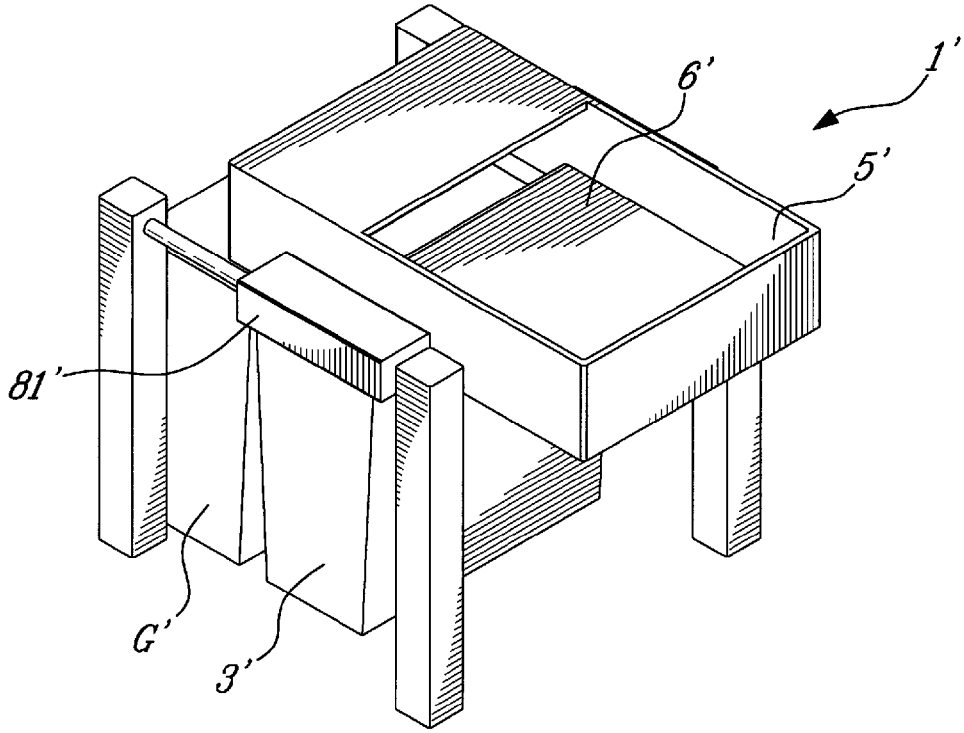

Referring to FIGS. 7*a* and 7*b*, there is shown a first alternative illustrative embodiment of the object recuperating apparatus 1' using a linear conveyor 6' co-operating with a refuse container G'. It can be seen that the apparatus 1' comprises an inlet tray 5', a moving member in the form of a motor driven linear belt conveyor 6' forming the bottom of the tray 5', an object detector 13' mounted under the downstream end of the conveyor 6', a recuperation container 3' and a conveyor translating linear actuator 81'.

In operation, the conveyor 6' in its most downstream position, as seen in FIG. 7*a*, drops mixture in refuse container G' as long as no object is detected by object detector 13'. When an object is detected by object detector 13', conveyor 6' is stopped and moved by actuator 81' to an upstream recuperation position, as seen in FIG. 7*b*, to enable discharging of the detected object into the recuperation container 3' and reactivates the conveyor 6'. When the object detector 13' does not detect the object anymore, conveyor 6' is stopped and moved by actuator 81' back to the downstream position so as to continue dropping mixture in refuse container G'.

Alternatively, the conveyor 6' may be in the form of a translating arm, advantageously a translating squeegee arm.

Second Alternative Illustrative Embodiment

Figure 8:
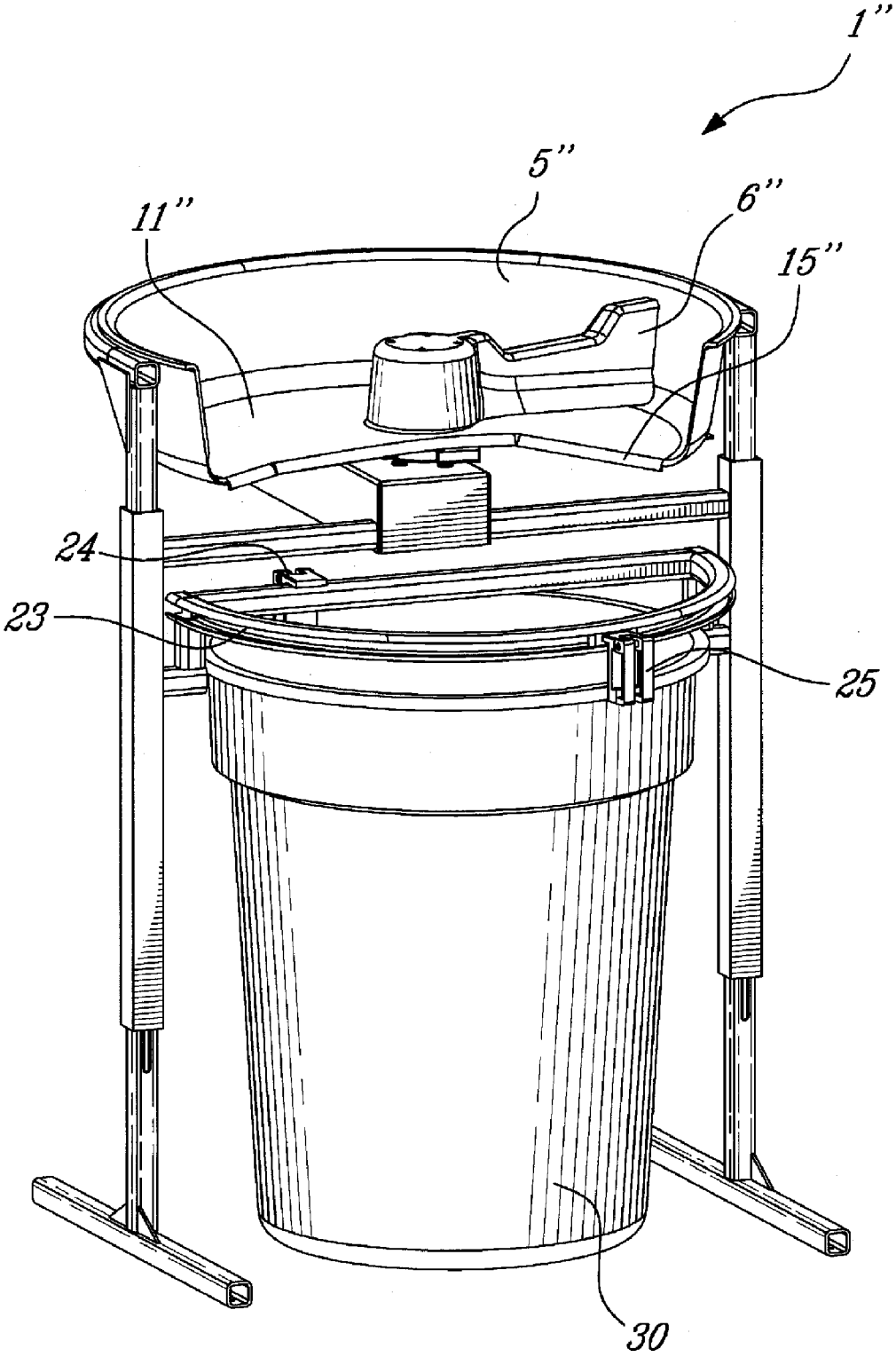
FIG. 8 is a top left isometric view of an object recuperation apparatus according to a second alternative illustrative embodiment of the present invention.
Figure 9A:
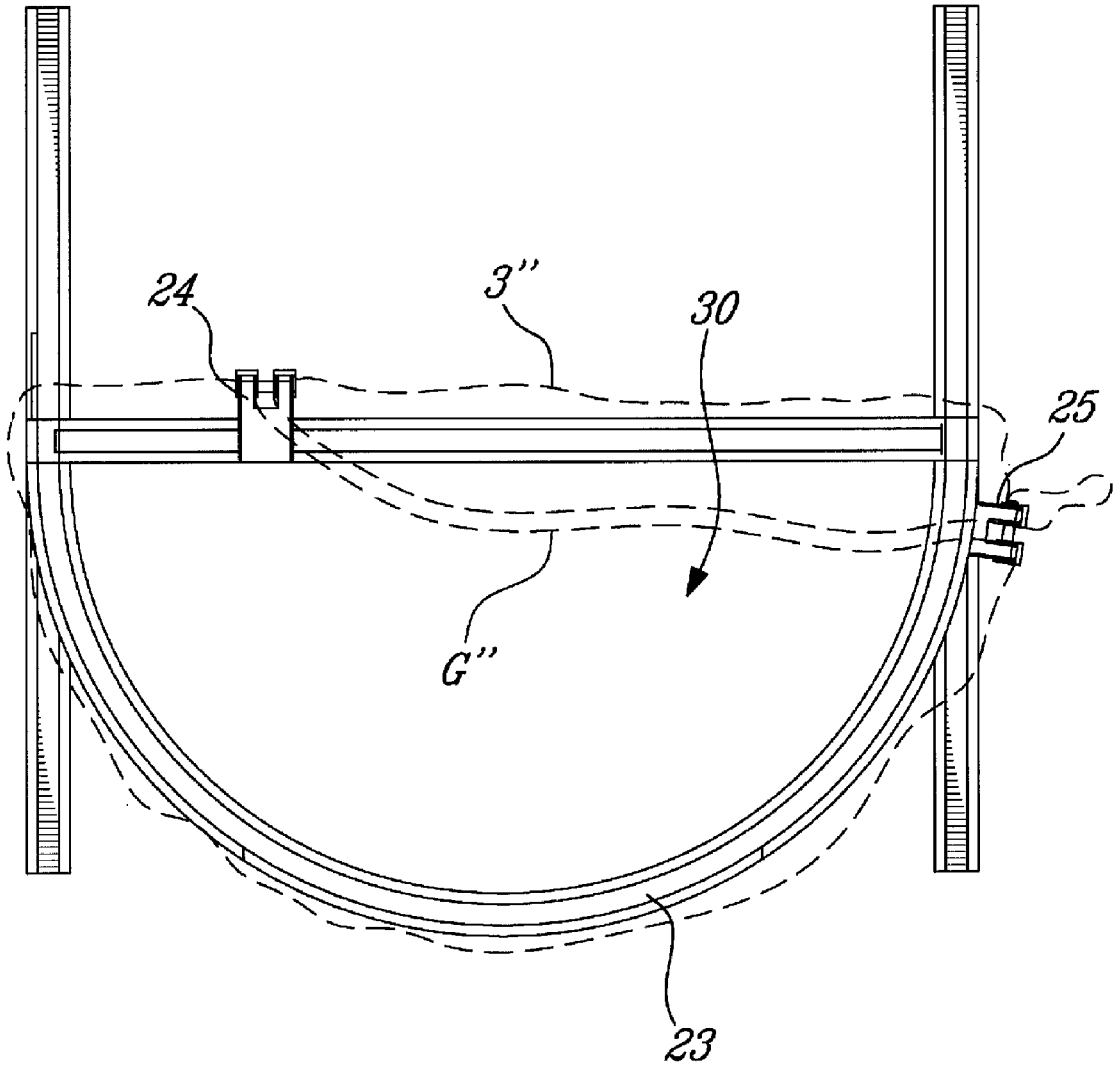
FIGS. 9*a* and 9*b* are a top plan view of the mobile chariot of the object recuperation apparatus of FIG. 8, shown in a first position (FIG. 8*a*) wherein a bag is substantially closed and in a second position (FIG. 8*b*) wherein the bag is substantially open.
Figure 9B:
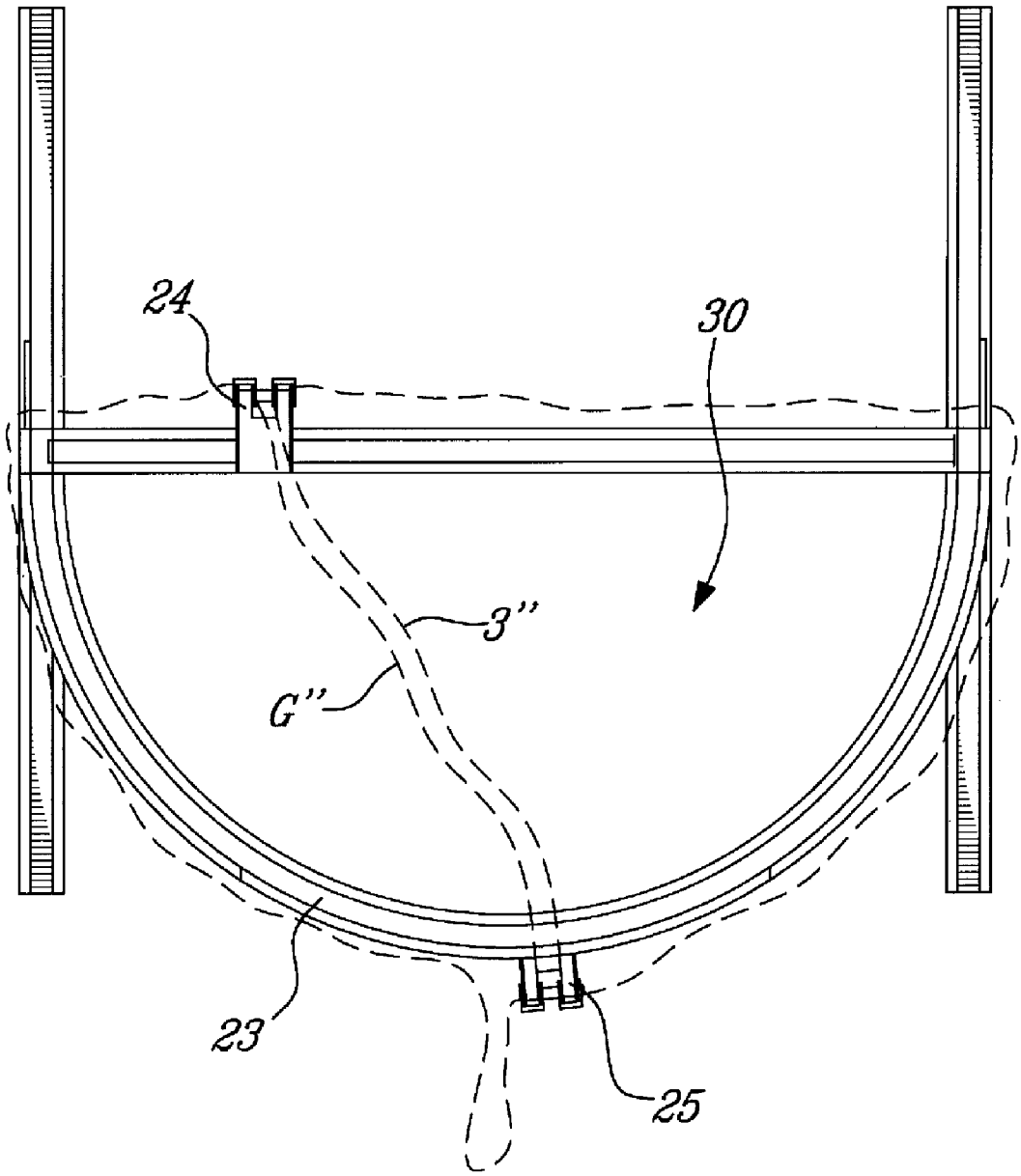

Referring to FIGS. 8, 9*a* and 9*b*, there is shown a second alternative illustrative embodiment of the object recuperating apparatus 1" similar to the object recuperating apparatus 1 of FIGS. 1 to 6 with the refuse container G and recuperation container 3 being made of a flexible material, e.g. refuse bag G" and recuperation bag 3", mounted as a configurable dual container 30.

In a first mode of operation, best seen in FIG. 9*a*, the refuse bag G" and recuperation bag 3" are each removably connected at a first point to a fixed clamp 24 and at an opposed second point to a mobile clamp 25 which slidingly engaged to rail 23 such that the refuse bag G" is substantially open to receive mixture pushed by the squeegee arm 6" rotating in, for example, the clockwise direction when reaching the end (border) 15" of the downstream portion of tray bottom 11". In this first mode of operation, the recuperation bag 3" is substantially closed and can not receive mixture pushed by the squeegee arm 6". In a second mode of operation, when the object detector (not shown) positioned near the end 15" of the downstream portion of tray bottom 11" detects an object in the mixture, the squeegee arm 6" is stopped and the mobile clamp 25 is slid about rail 23 so as to change the ratio of opened surface of the refuse G" and recuperation 3" bags such that the recuperation bag 3" is now substantially open, as best seen in FIG. 9*b*, to enable discharging of the detected object into the recuperation bag 3" and reactivates the squeegee arm 6". When the object detector (not shown) does not detect the object anymore, squeegee arm 6" is stopped and mobile clamp 25 is slid back along rail 23 so as to continue dropping mixture into refuse bag G". It should be understood that according this mode of operation, the tray 5" does not have to be movable and that tray driving components such as motor 90*b* may be omitted in this alternative embodiment.

Third Alternative Illustrative Embodiment

Figure 10:
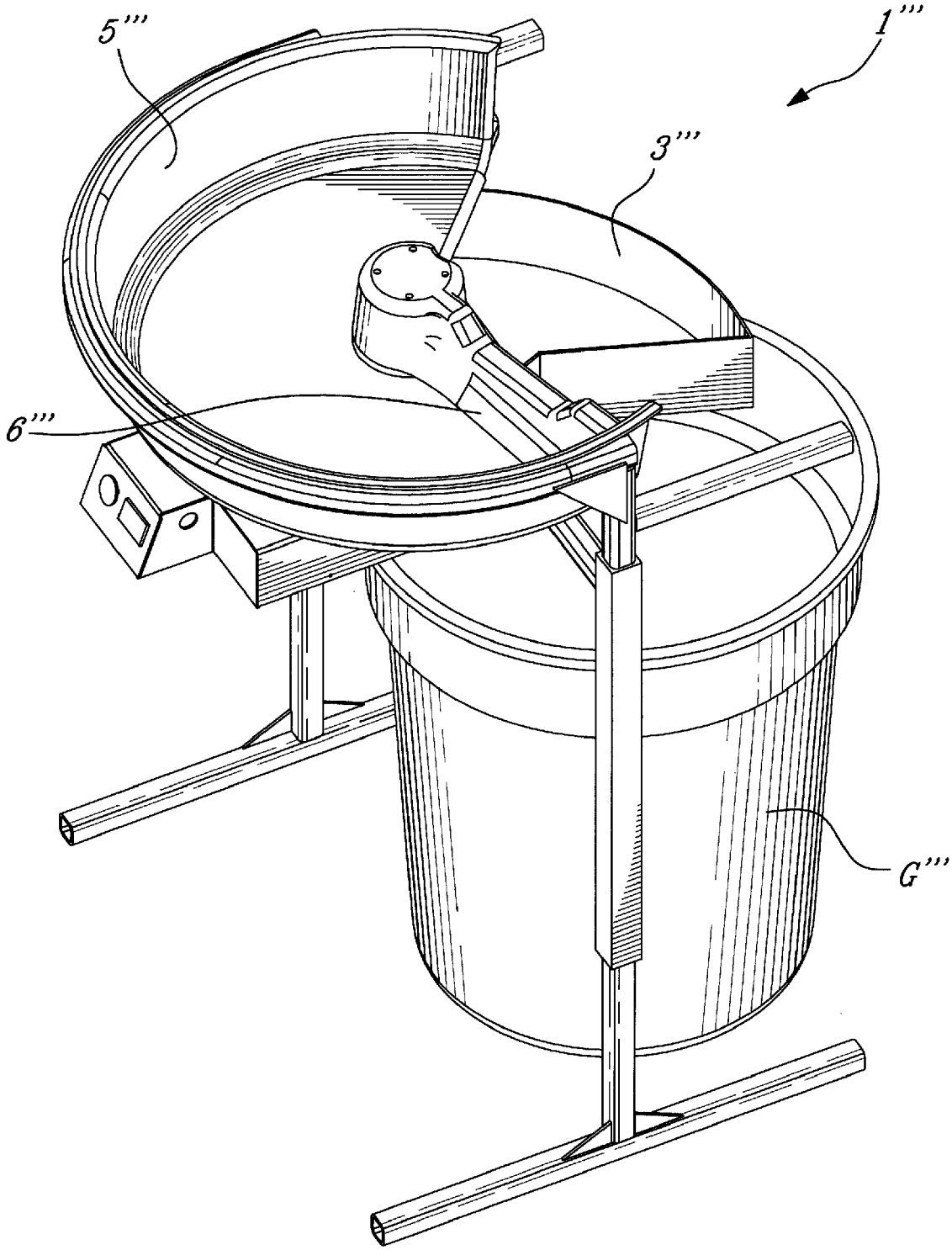
FIG. 10 is a top right isometric view of an object recuperation apparatus according to a third alternative illustrative embodiment of the present invention.

Referring to FIG. 10, there is shown a third alternative illustrative embodiment of the object recuperating apparatus 1''' similar to the object recuperating apparatus 1 of FIGS. 1 to 6 wherein the tray 5''' is fixed and the recuperation container 3''' is movable, for example by being mounted on a turntable, so as to selectively receive the mixture pushed by the squeegee arm 6''' into the refuse container G''' or into the recuperation container 3''' instead of moving the tray 5'''. Alternatively, this concept may also be applied to the object recuperating apparatus 1' of FIGS. 7*a* and 7*b* by providing a fixed conveyor 6' and having the actuator 81' move the refuse container G' or the recuperation container 3' so as to receive the mixture conveyed by the conveyor 6'.

It is to be understood that the above described alternative illustrative embodiments have been described so as to emphasize the main operational and physical differences without going into a detailed description of all of their respective components. Accordingly, it is to be understood that the above described alternative illustrative embodiments may also comprise components having similar functions as those described for the object recuperating apparatus 1 of FIGS. 1 to 6. For example, the above described alternative illustrative embodiments may also comprise a drive/control module with a presence sensor and ON/OFF button to control their operation or various motors to effectuate desired movements of some components.

Method of Recuperation

Figure 11:
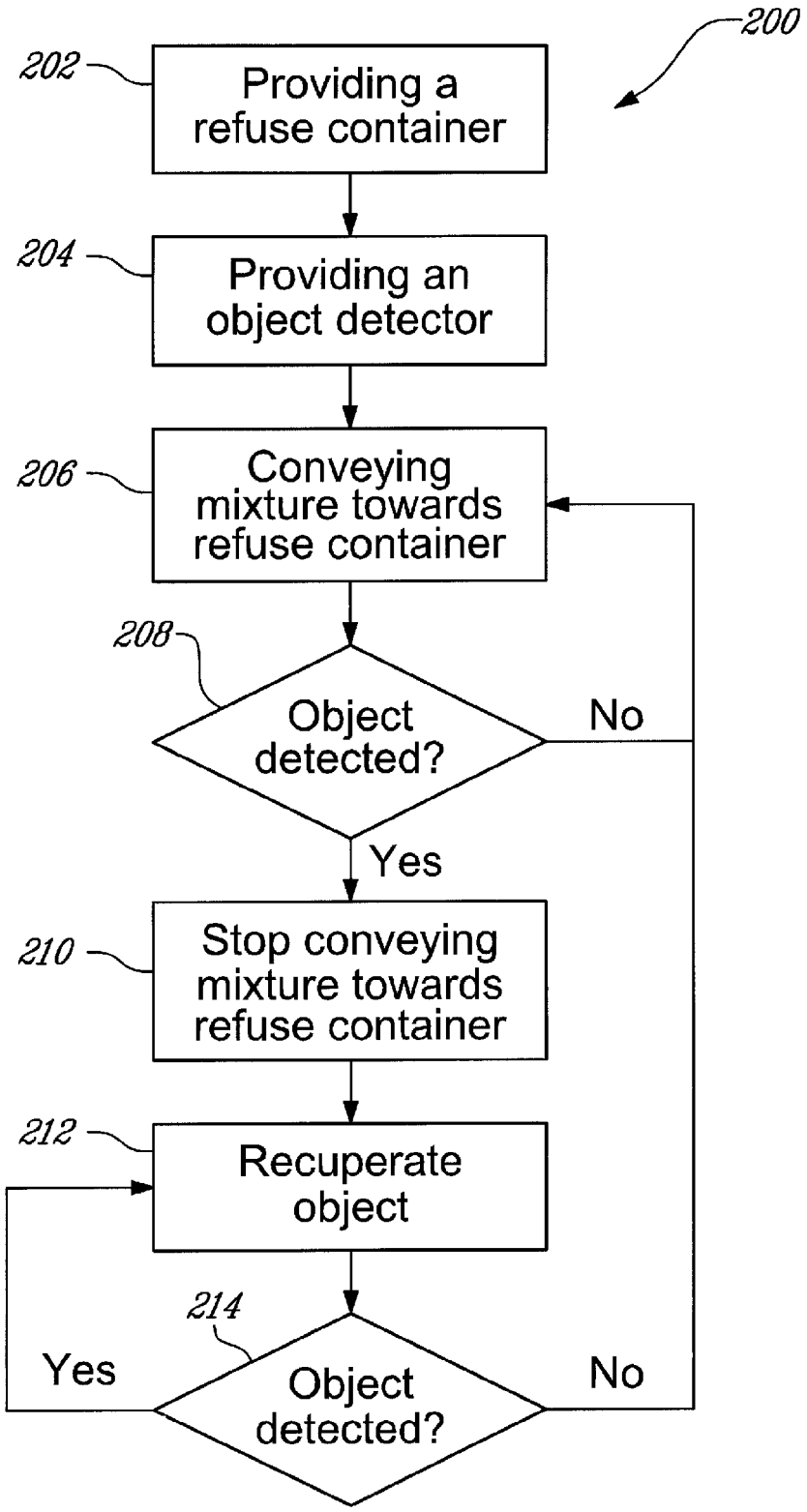
FIG. 11 is a flow diagram of an object recuperation method according to an illustrative embodiment of the present invention.

Referring now to FIG. 11, there is shown a flow diagram of an illustrative example of a method 200 for recuperating objects from a mixture, such as, for example, wastes. The steps of the method are indicated by blocks 202 to 214.

The method 200 starts by providing a refuse container, at block 202, and an object detector, at block 204.

At block 206, the mixture is conveyed towards the refuse container at a predetermined speed.

Then, at block 208, if no object is detected by the object detector, the method 200 proceeds back to block 206 where the mixture keeps being conveyed towards the refuse container. If an object is detected by the object detector, the method 200 proceeds to block 210 where the conveying of the mixture is stopped.

At block 212, the recuperation of the detected object from the mixture is performed.

Finally, at block 214, if the object is still detected by the object detector, the method 200 proceeds back to block 212 where the recuperation of the detected object is continued. If no object is detected by the object detector, the method 200 proceeds back to block 206 where the conveying of the mixture towards the refuse container is resumed.

It is to be understood that the speed at which the mixture is conveyed is set such that upon detection of an object within the mixture by the object detector, the conveying of the mixture towards the refuse container can be stopped before the detected object falls into the refuse container.

It is to be understood that the performing of the recuperation of the detected object from the mixture may be manual or may further comprise providing a recuperation container, clearing access to the recuperation container and conveying the object containing mixture at the predetermined speed toward the recuperation container.

Figure 12:
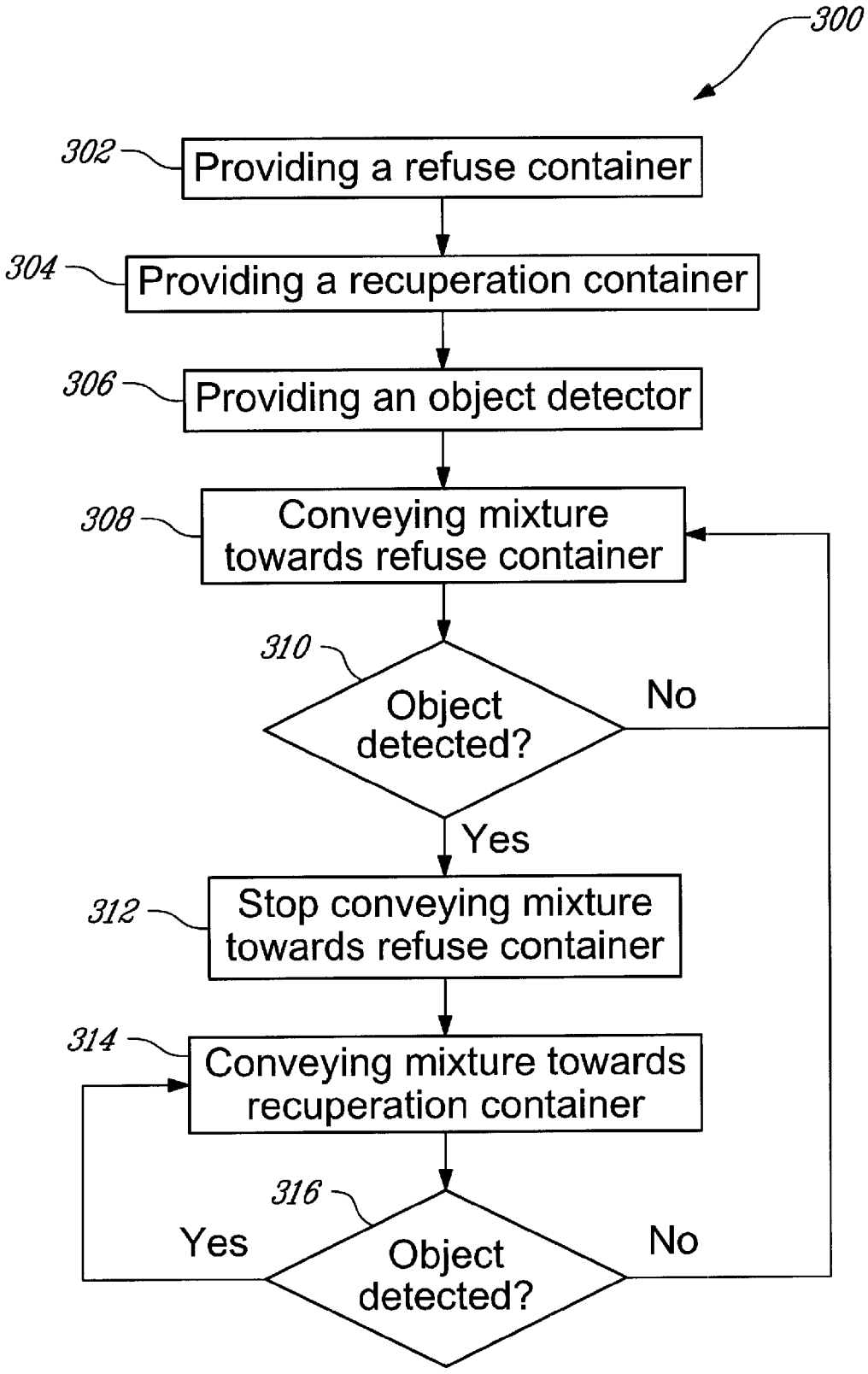
FIG. 12 is a flow diagram of an object recuperation method according to an alternative illustrative embodiment of the present invention.

For example, referring to FIG. 12, there is shown a flow diagram of an illustrative example of an alternative method 300 for recuperating objects from a mixture. The steps of the method are indicated by blocks 302 to 316.

The method 300 starts by providing a refuse container, at block 302, a recuperation container, at block 304, and an object detector, at block 306.

At block 308, the mixture is conveyed towards the refuse container at a predetermined speed.

Then, at block 310, if no object is detected by the object detector, the method 300 proceeds back to block 308 where the mixture keeps being conveyed towards the refuse container. If an object is detected by the object detector, the method 300 proceeds to block 312 where the conveying of the mixture is stopped.

At block 314, the mixture is conveyed towards the recuperation container.

Finally, at block 316, if the object is still detected by the object detector, the method 300 proceeds back to block 314 where the conveying of the mixture towards the recuperation container is continued. If no object is detected by the object detector, the method 300 proceeds back to block 308 where the conveying of the mixture towards the refuse container is resumed.

According to a further aspect of the invention, providing an object detector may comprise providing a magnetic object detector, and the method may further comprise magnetizing objects, or applying magnetic labels or incrustations (ex. by laser marking, hot stamping, etc.) on non-magnetic metal objects or a non-metal objects in order to enable positive and selective detection thereof.

In view of the foregoing description, it can be appreciated that the apparatus and method embodiments of the present invention advantageously provide reliable and practical solutions for the recuperation of objects, such as flatware, from mixtures, such as wastes, thus providing significant savings with minimal intervention from the users and perturbation of their normal behavior. Indeed, bus boys or waiters empty wastes in the apparatus 1 as they would do in a garbage can, paying attention only to their normal responsibilities (no delays, no contamination by contacting the wastes). Recuperated objects are merely added to the dishes to be washed at the end of the day. The simple apparatus structure further enables easy maintenance and cleaning.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the invention has been described herein by way of illustrative embodiments thereof, many modifications and applications may be contemplated without departing from the spirit of the invention. For example, the method and the apparatus would perform as well for separating flatware from food wastes in restaurant, as for separating medical instruments from hospital wastes, or finding metal containing objects in a lot of plastic containers to be recycled, detecting object containing a ferromagnetic material, etc. Also, the type of object detector used is not limited to ferromagnetic detectors and may comprises any type of detector able to detect a specific known property of foreign objects mixed with other objects. Given the intrinsic working process of the invention, the only essential performance criteria is that objects to be recuperated be detectable from a distance through the mixture and occupy a minor portion of the volume of the mixture to be processed.

What is claimed is:

1. An apparatus for recuperating at least one target object from a mixture conveyed to a refuse container, the apparatus comprising:

a tray having an upstream end for receiving the mixture and a downstream end adapted to be positioned above the refuse container;

a moving member for conveying the mixture at a predetermined speed from the upstream end to the downstream end of the tray;

a control module; and a target object detector mounted near the downstream end of the tray, the object detector providing a first signal to the control module when no target object is detected in the mixture and a second signal when a target object is detected in the mixture;

whereby the control module stops the moving member from conveying the mixture upon reception of the second signal so that the detected target object can be recuperated; further comprising a recuperation container and wherein the control module includes an actuator operatively connected to the tray, whereby the control module stops the moving member from conveying the mixture upon reception of the second signal, activates the actuator so that the downstream end of the tray is positioned above the recuperation container and resumes the moving member conveying the mixture and stops the moving member from conveying the mixture upon reception of the first signal, activates the actuator so that the downstream end of the tray is positioned above the refuse container and resumes the moving member conveying the mixture.

2. An apparatus according to claim 1, wherein the control module resumes the moving member conveying the mixture upon reception of the first signal.

3. An apparatus according to claim 2, further comprising a recuperation container and wherein the control module includes an actuator operatively connected to at least one of the refuse container and the recuperation container, whereby the control module stops the moving member from conveying the mixture upon reception of the second signal, activates the actuator so that the recuperation container is positioned under the downstream end of the tray and resumes the moving member conveying the mixture and stops the moving member from conveying the mixture upon reception of the first signal, activates the actuator so that the refuse container is positioned under the downstream end of the tray and resumes the moving member conveying the mixture.

4. An apparatus according to claim 3, wherein the refuse and recuperation containers are made of a flexible material and whereby activation of the activator upon reception of the second signal substantially opens the recuperation container under the downstream end of the tray and activation of the activator upon reception of the first signal substantially opens the refuse container under the downstream end of the tray.

5. An apparatus according to claim 2, wherein the predetermined speed is set such that upon reception of the second signal, the control module is able to stop the moving member from conveying the mixture before the target object falls into the refuse container.

6. An apparatus according to claim 2, wherein the target object contains a ferromagnetic material and the target object detector is a ferromagnetic material detector.

7. An apparatus according to claim 2, wherein the at least one target object is magnetized and the target object detector is a magnetic object detector.

8. An apparatus according to claim 2, wherein the moving member is selected from a group consisting of a rotating arm, a translating arm and a linear belt.

9. An apparatus according to claim 8, wherein the rotating arm is a rotating squeegee arm and the translating arm is a translating squeegee arm.

10. A method for recuperating at least one target object from a mixture, the method comprising providing a tray having an upstream end for receiving the mixture and a downstream end adapted to be positioned above the refuse container:

providing a refuse container;

providing a target object detector;

providing a rotating arm for conveying the mixture at a predetermined speed toward the refuse container;

stopping conveying the mixture to the refuse container upon detection of a target object in the mixture by the target object detector and recuperating the target object from the mixture; and resuming conveying the mixture at the predetermined speed towards the refuse container upon non-detection of the target object by the target object detector.

11. A method according to claim 10, further comprising providing a recuperation container, wherein the step of recuperating the target object from the mixture comprises conveying the target object containing mixture towards the recuperation container until non-detection of the target object by the object detector.

12. A method according to claim 10, wherein the predetermined speed is set such that upon detection of a target object in the mixture by the target object detector, the conveying of the mixture towards the refuse container can be stopped before the target object falls into the refuse container.

13. A method according to claim 10, wherein the target object contains a ferromagnetic material and the target object detector is a ferromagnetic material detector.

14. A method according to claim 10, further comprising magnetizing the at least one target object and wherein the target object detector is a magnetic object detector.

15. An apparatus for recuperating at least one target object made of a ferromagnetic metal from wastes conveyed to a refuse container, the apparatus comprising:

a reciprocal tray having an upstream end for receiving the wastes and a downstream end adapted to be positioned above the refuse container;

a rotating squeegee arm for conveying the wastes at a predetermined speed from the upstream end to the downstream end of the tray;

a recuperation container;

a control module including an actuator operatively connected to the tray; and a ferromagnetic metal detector mounted near the downstream end of the tray, the ferromagnetic metal detector providing a first signal to the control module when no target object is detected in the mixture and a second signal when a target object is detected in the mixture;

whereby the control module stops the rotating squeegee arm from conveying the wastes upon reception of the second signal, activates the actuator rotating the tray in a first direction so that the downstream end of the tray is positioned above the recuperation container and resumes the rotating squeegee arm conveying the wastes and stops the rotating squeegee arm from conveying the wastes upon reception of the first signal, activates the actuator rotating the tray in a second direction opposed to the first direction so that the downstream end of the tray is positioned above the refuse container and resumes the rotating squeegee arm conveying the wastes.

* * * * *